United States Patent [19]

Dickie et al.

[11] Patent Number: 5,064,309

[45] Date of Patent: Nov. 12, 1991

[54] DOCKSIDE SPILL CONTAINMENT SYSTEM

[76] Inventors: Gerald M. Dickie, 2178 Lomina Ave.; Steve L. Liles, 1925 Pattiz Ave., both of Long Beach, Calif. 90815; Alan H. Woldvedt, 12574 Bellder Dr., Downey, Calif. 90242

[21] Appl. No.: 551,462

[22] Filed: Jul. 12, 1990

[51] Int. Cl.[5] ..... E02B 15/06

[52] U.S. Cl. ..... 405/64; 405/68; 405/72

[58] Field of Search ..... 405/63, 64, 66, 68, 405/72; 210/923

[56] References Cited

U.S. PATENT DOCUMENTS

| | | | |
|---|---|---|---|
| 136,817 | 3/1873 | Cooper . | |
| 312,613 | 2/1885 | Corey . | |
| 351,971 | 11/1886 | Frisbie . | |
| 381,302 | 4/1888 | Weihe . | |
| 387,200 | 7/1888 | Schultz . | |
| 564,144 | 7/1896 | Bricard . | |
| 770,078 | 9/1904 | Kruger . | |
| 1,107,680 | 8/1914 | Lucka . | |
| 1,253,293 | 1/1918 | Sons . | |
| 1,303,049 | 5/1919 | Endreson . | |
| 1,307,040 | 6/1919 | Christensen . | |
| 1,511,155 | 10/1924 | Blumberg . | |
| 1,573,909 | 2/1926 | Blumberg . | |
| 1,660,114 | 2/1928 | Blumberg . | |
| 2,821,298 | 1/1958 | Richards | 206/47 |
| 3,779,020 | 12/1973 | Muramatsu | 405/64 |
| 3,922,861 | 12/1975 | Grihangne | 405/68 X |
| 4,015,431 | 4/1977 | Ahiko | 405/68 |
| 4,161,155 | 7/1979 | Cloutier | 114/227 |
| 4,201,495 | 5/1980 | Preus | 405/63 |
| 4,215,644 | 8/1980 | Jackson | 405/64 X |
| 4,252,461 | 2/1981 | Colamussi et al. | 405/64 X |
| 4,439,324 | 3/1984 | Crotti | 210/691 |
| 4,569,303 | 2/1986 | McDuff et al. | 114/227 |
| 4,712,502 | 12/1987 | McDuff et al. | 114/227 |

*Primary Examiner*—David H. Corbin

*Attorney, Agent, or Firm*—Fulwider, Patton, Lee & Utecht

[57] ABSTRACT

A system for containing spillage from a tanker at a moorage. The system in its deflated stated state remains submerged so as not to obstruct the passage of a vessel thereover. Once a vessel is moored in place thereover, the perimeter boom is inflated to bring the boom to the surface to surround the entire ship. A liner contingu-ously attached to the boom extends downwardly to form impermeable walls and a floor below the tanker. The system is routinely deployed prior to any on-loading or off-loading operation when spills are most likely to occur. Deflation of the boom upon completion of the operation causes the entire system to once again assume its submerged state.

8 Claims, 2 Drawing Sheets

DOCKSIDE SPILL CONTAINMENT SYSTEM

BACKGROUND OF THE INVENTION

1. Field of the Invention

The present invention generally relates to spill containment systems and more particularly pertains to devices for confining cargo leaking from watercraft at a moorage.

2. Description of the Prior Art

Spillage of cargo from an oil tanker, whether on the high seas, near an ecologically sensitive coastline, or at dockside has an adverse effect on the environment and exposes all involved parties to substantial liabilities. Although spills at dockside typically involve orders of magnitude less oil than spills resulting from damage to a tanker while underway, the frequency of the small dockside mishaps are far greater and the pollution of a harbor environment is no less undesirable.

Various systems have been devised to prevent or minimize spillage, contain spillage, recover spillage, and/or treat spillage. None provide an effective and economically feasible means to reduce the environmental impact to an acceptable level. The magnitude of effort required to recover or treat an uncontained spill defies solution while the logistical impossibility of addressing all possible contingencies renders absolute prevention similarly unattainable. Efforts directed to containment therefore appear to offer the most potential as an effective and feasible solution. However, no systems have been disclosed that are routinely, quickly and easily deployable, are capable of positively confining a spill, and are readily implemented on an industry-wide basis in a relatively economical fashion.

The system currently most often relied upon at dockside requires the placement of floating booms around the perimeter of a tanker during on-loading or off-loading. In the event of a spill, such booms are effective to prevent a film or thin layer of oil from spreading, but such a system is substantially incapable of containing a significant volume of spillage. Although the oil does float on water, it freely passes underneath such booms once sufficient oil is present to float the booms. The fitment of a curtain-like structure, extending a short distance below such floating booms, does enhance the efficacy of such a system, but nonetheless fails to provide a structure that is capable of positively confining spillage.

Additional shortcomings relate to the effort typically required to deploy the described conventional system about the entire tanker once moored. The booms must typically be manually maneuvered into place, either from a small launch or from the deck of the tanker. A similar effort is required to remove the system when the vessel is ready for departure.

SUMMARY OF THE INVENTION

The present invention provides a system for containing cargo, such as oil, spilled from a ship at a moorage. The device is permanently installed directly below such a moorage and is routinely deployed during all on-loading and off-loading operations. In its fully deployed state the system provides a floating perimeter boom that surrounds the entire tanker at the water's surface, and an impermeable liner that is contiguously attached to the boom and extends downwardly therefrom to completely enclose the area below the vessel. The floor of the system is either adequately weighted and rests directly on the harbor bottom, or in deeper water, is anchored and tethered in position. Inflation of the perimeter boom serves to deploy the system. In its deflated state, the boom and attached liner have a negative buoyancy to ensure that the system sinks to the bottom so as not to obstruct the passage of a vessel thereover. Upon inflation, the boom provides sufficient positive buoyancy to quickly cause it, as well as the wall defined by the attached liner, to rise into position. An air source, such as a dockside air pump, serves to quickly inflate the boom, while venting the inflated boom to the atmosphere, or alternatively, using the air pump to actively deflate the boom serves to quickly submerge the system.

The system is routinely deployed during on-loading and off-loading operations. If a spill occurs, the barrier serves to positively contain any such spillage until a clean-up operation can be undertaken. Once the off-loading or on-loading operation is complete, and once a clean-up of any spillage that may have occurred has been completed, the boom is deflated to allow the boom and attached liner to sink so that the tanker can then freely pass thereover.

Other features and advantages of the present invention will become apparent from the following detailed description, taken in conjunction with the accompanying drawings, which illustrate by way of example, the principles of the invention.

DETAILED DESCRIPTION OF THE PREFERRED EMBODIMENT

The figures generally illustrate the preferred embodiment of the present invention as adapted for use at a docking facility where oil tankers are on-loaded and off-loaded. The system is disposed below the surface of the water in a position coinciding with the position a tanker assumes when moored along side the docking facility. Once a tanker is in position and before the handling of its cargo is commenced, the system is deployed to provide an impermeable barrier to positively contain or confine any spillage that may issue from the moored vessel.

Figure 1:
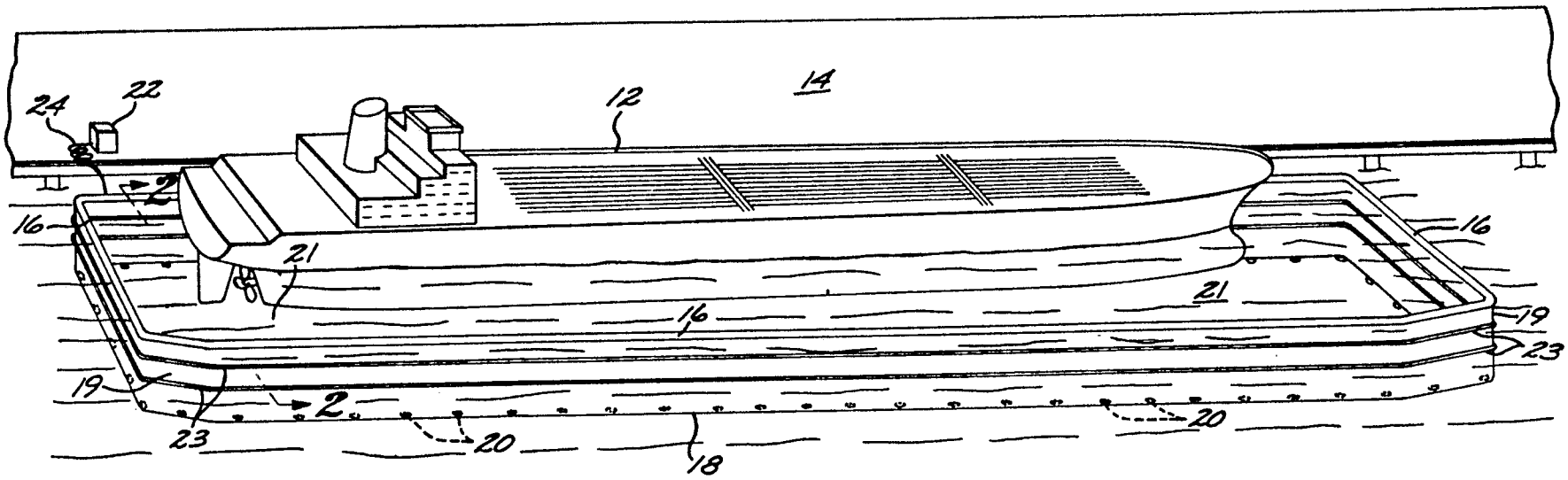
FIG. 1 is a perspective view of the containment system of the present invention in its fully deployed state.
Figure 2:
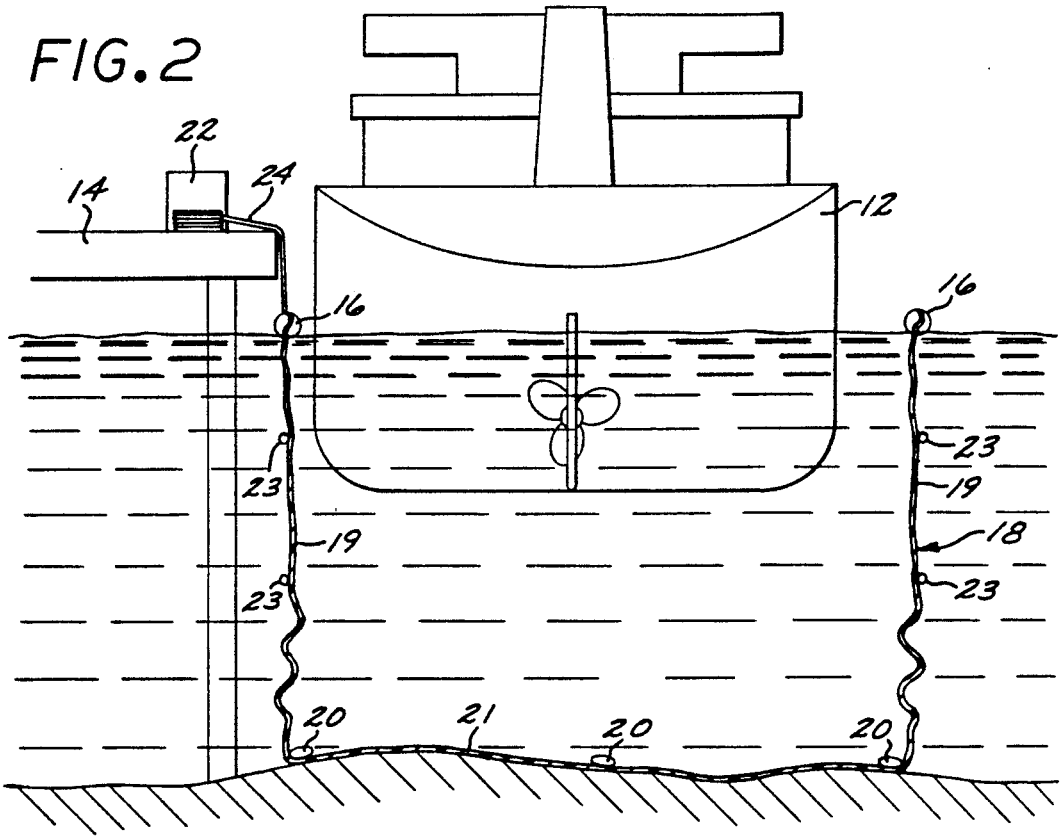
FIG. 2 is an enlarged cross-sectional view taken along lines 2—2 of FIG. 1.

FIGS. 1 and 2 illustrate the containment system of the present invention in its fully deployed state. The figures show ship 12 moored along side docking facility 14. The containment system's inflatable perimeter boom 16 surrounds the entire tanker 12 at the water's surface. Liner 18, contiguously affixed to boom 16 along its entire length, extends downwardly therefrom to form substantially vertical walls 19 and a floor 21. The liner 18 is anchored in position by a plurality of weights 20 distributed about the structure's floor 21. A plurality of stiff and weighted ribs 23 are incorporated in the liner about its entire periphery. The ribs 23 may consist of, for example, lengths of interconnected stainless steel piping of sufficient wall thickness to impart a substantial amount of negative buoyancy to the liner 18 and to impart a substantial degree of stiffness to the deployed liner wall 19. An air source, such as a high-volume air pump 22, is positioned on the dock 14 and is adapted to supply air to boom 16 via duct 24.

The dimensions of the liner 18 and the positions of the weights 20 are selected so as to ensure that the inflated boom 16 is always able to float on the water's surface. In order to accommodate tidal fluctuations and wave action, a substantial amount of slack is provided in the vertical portions of liner 18 as apparent in FIG. 2.

Figure 3:
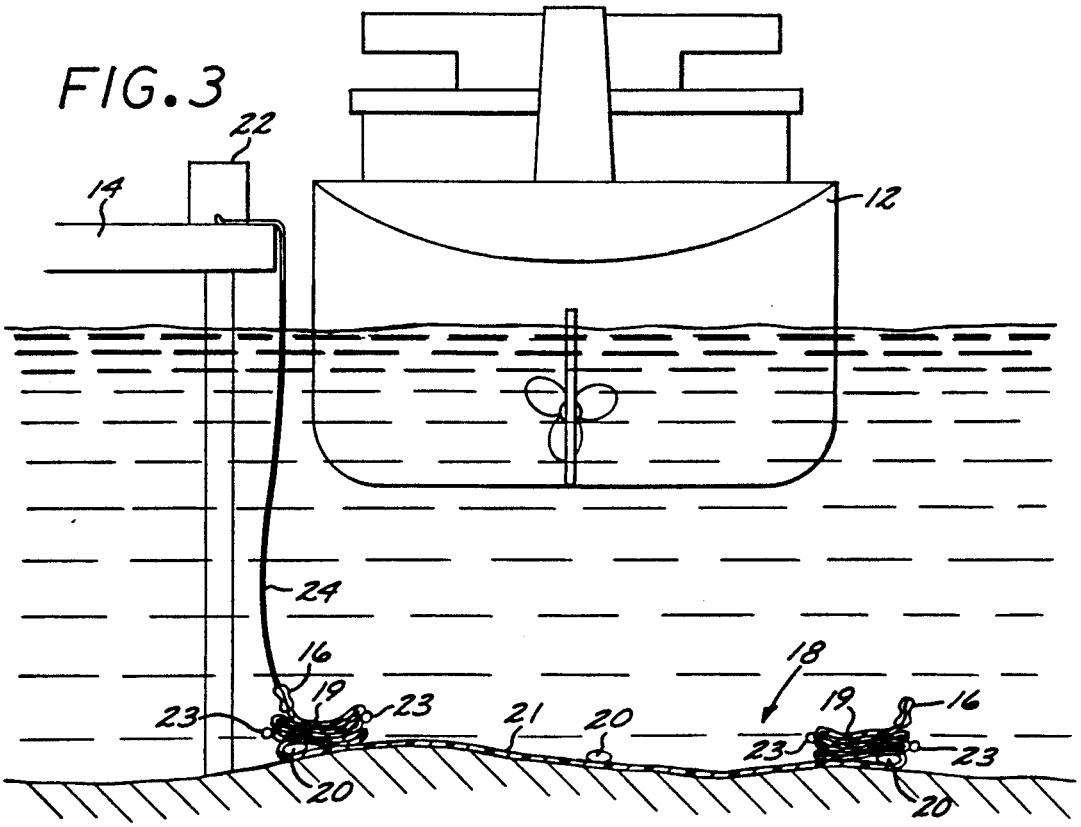
FIG. 3 is a cross-sectional view, similar to the view of FIG. 2, wherein the containment system of the present invention is in its collapsed form.

FIG. 3 illustrates the containment system in its collapsed, deflated state. Upon deflation of boom 16, the entire system sinks and comes to rest on the harbor floor to ensure that tanker 12 can freely pass thereover. The weighted ribbing 23 serve to both expedite the sinking and collapsing of the liner walls 19 as well as ensure that the liner walls 19 settle to a position substantially below their intended deployed positions. In order to further expedite the deflation of boom 16, air pump 22 can be employed to actively draw air out of the boom. Alternatively, duct 24 can simply be disconnected from air source 22 and vented to the atmosphere. Duct 24 is of sufficient length to maintain communication between air source 22 and boom 16 while the system is in its submerged position.

Figure 4:
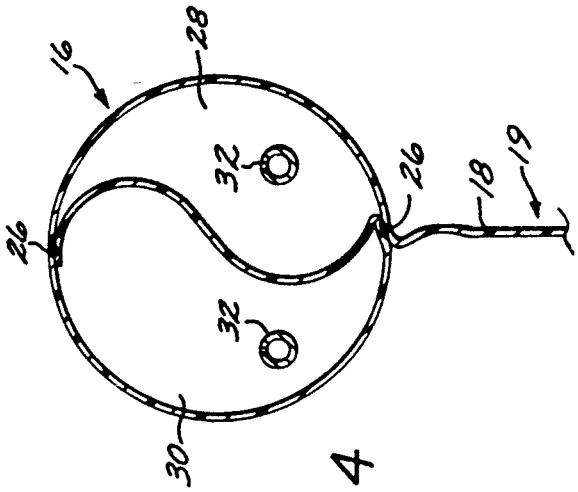
FIG. 4 is enlarged cross-sectional view taken along lines 4—4 of FIG. 1.

FIG. 4 provides an enlarged cross-sectional view of boom 16. In the preferred embodiment the liner 18 is in essence folded twice and fusion welded along the contact lines 26 to form two independently inflatable cells 28 and 30. The liner material is a PVC film. This type of material's tensile strength, its light weight and the capability of being fusion welded renders it ideal for this application. Each inflatable cell 28, 30, accommodates therein a perforated conduit or pipe 32 which facilitates the evacuation of air from within the cells. A non-collapsing conduit interconnects the perforated conduit 32 and the intake side of air pump 22 and may be accommodated within duct 24.

In use, the system is routinely deployed every time a tanker is moored alongside docking facility 14 for the purpose of on-loading or off-loading a cargo of oil. With the tanker 12 is in position, compressed air generated by source 22 is ducted to inflatable boom 16 via duct 24. Once a sufficient quantity of air has been introduced into cells 28 and 30 to impart a positive buoyancy to the device, boom 16 with liner 18 extending therebelow rises to the surface to form the barrier. The tanker can then safely be either on-loaded or off-loaded as the deployed system would ensure that any oil that is spilled during such an operation would be confined therein and could not spread. If a spill does in fact occur, the spillage, confined within the perimeter defined by containment system of the present invention can easily be sucked up by the appropriate equipment. Once the on-loading and off-loading operation is complete, the boom 16 is deflated which causes the boom 16 and walls 19 defined by liner 18 to collapse and settle to the bottom. At this point, the tanker 12 can freely pass thereover. The weighted ribbing 23 ensures that the liner 18 and boom 20 sink as quickly as possible, and additionally causes the liner 18 to collapse in an accordion-like fashion directly below its deployed position. In the event air pump 22 is employed to actively deflate boom 20, the perforated piping 32 within cells 28 & 30 ensures that air can continue to withdraw from within the boom despite the collapse of its walls.

While a particular form of the invention has been illustrated and described, it will also be apparent to those skilled in the art that various modifications can be made without departing from the spirit and scope of the invention. Accordingly, it is not intended that the invention be limited except as by the appended claims.

What is claimed is:

1. A spill containment system for containing spillage of cargo from a ship moored above a preselected area of seafloor, comprising:

an inflatable boom configured and dimensioned to surround such ship at the water's surface when inflated;

an impermeable liner, contiguously attached to said boom and dimensioned to extend from the water's surface to the seafloor;

means for securing said liner to the seafloor such that a portion of said liner is in contiguous contact with the seafloor at all times; and means for alternately inflating and deflating said boom whereby, upon inflation of the boom, the boom and attached liner rises to form an impermeable barrier about the ship and upon deflation, the entire system sinks so as not to obstruct the passage of such ship thereover.

2. The system of claim 1 wherein said boom comprises an inflatable cavity formed by folding over the periphery of said liner and fusing said periphery of said liner to said liner.

3. The system of claim 2 further comprising a plurality of rigid ribs accommodated in the liner oriented in a parallel configuration relative to said boom to simultaneously impart dimensional stability to the liner as well as negative buoyancy to the entire system upon deflation of the boom.

4. The system of claim 2 wherein said liner comprises a PVC film.

5. The system of claim 1 wherein a portion of said liner forms a floor resting directly on said preselected area of seafloor and said securing means comprises a plurality of weights placed on said floor.

6. The system of claim 1 wherein said inflating means comprises a high-volume air pump in communication with said boom.

7. The system of claim 1 wherein said deflating means comprises a high-volume air pump in communication with said boom.

8. The system of claim 7 further comprising a perforated conduit positioned within said boom in communication with said air pump.

* * * * *